US011731422B2

(12) United States Patent
Kanzaki et al.

(10) Patent No.: US 11,731,422 B2
(45) Date of Patent: Aug. 22, 2023

(54) LIQUID DISCHARGING HEAD

(71) Applicant: Brother Kogyo Kabushiki Kaisha, Nagoya (JP)

(72) Inventors: Shotaro Kanzaki, Handa (JP); Keita Sugiura, Toyokawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 10 days.

(21) Appl. No.: 17/693,786

(22) Filed: Mar. 14, 2022

(65) Prior Publication Data

US 2022/0297426 A1 Sep. 22, 2022

(30) Foreign Application Priority Data

Mar. 22, 2021 (JP) ..... 2021-047004

(51) Int. Cl.
*B41J 2/14* (2006.01)

(52) U.S. Cl.
CPC ..... *B41J 2/14* (2013.01); *B41J 2002/14419* (2013.01); *B41J 2202/11* (2013.01)

(58) Field of Classification Search
CPC B41J 2/14; B41J 2002/14419; B41J 2202/11; B41J 2/14233; B41J 2002/14306; B41J 2002/14459; B41J 2202/12
See application file for complete search history.

(56) References Cited

U.S. PATENT DOCUMENTS

| | | | | |
|---|---|---|---|---|
| 10,906,306 | B2 | 2/2021 | Tamai et al. | |
| 11,040,534 | B2 | 6/2021 | Miyagishi | |
| 2019/0299620 | A1* | 10/2019 | Koide | B41J 2/145 |
| 2020/0198348 | A1 | 6/2020 | Tamai et al. | |
| 2020/0207090 | A1 | 7/2020 | Miyagishi | |

FOREIGN PATENT DOCUMENTS

| | | | |
|---|---|---|---|
| JP | 2020-100055 | A | 7/2020 |
| JP | 2020-104364 | A | 7/2020 |

* cited by examiner

*Primary Examiner* — Lisa Solomon
(74) *Attorney, Agent, or Firm* — Banner & Witcoff, Ltd.

(57) ABSTRACT

A liquid discharging head includes: individual channels; a first common liquid chamber provided commonly for the individual channels; and a second common liquid chamber provided commonly for the individual channels. Liquid is supplied from the first common liquid chamber to the individual channels and the liquid flows into the second common liquid chamber from the individual channels. Each of the individual channels has: a pressure chamber; a first channel; a nozzle connected to the first channel and configured to discharge the liquid; a second channel separated from the nozzle in a first direction and connecting the pressure chamber and the first channel; and a third channel connected to the first channel on a side opposite to the second channel in the first direction with the nozzle sandwiched between the third channel and the second channel.

10 Claims, 10 Drawing Sheets

LIQUID DISCHARGING HEAD

CROSS REFERENCE TO RELATED APPLICATIONS

The present application claims priority from Japanese Patent Application No. 2021-047004, filed on Mar. 22, 2021, the disclosure of which is incorporated herein by reference in its entirety.

BACKGROUND

The present disclosure relates to a liquid discharging head which discharges liquid from nozzles.

Description of the Related Art

As an example of a liquid discharging head which discharges liquid from nozzles, an ink-jet recording head which discharges ink from nozzles has been known. The ink-jet recording head includes a plurality of individual channels communicating with a plurality of nozzles respectively, and a first common liquid chamber provided commonly for the plurality of individual channels to supply ink to the plurality of individual channels. The plurality of individual channels has a plurality of pressure chambers. Moreover, by changing pressure on the ink in the plurality of pressure chambers by a piezoelectric actuator, ink droplets are discharged from the plurality of nozzles.

The ink-jet recording head includes a second common liquid chamber provided commonly for the plurality of individual channels, and the ink flows into the second common liquid chamber from the plurality of individual channels. The ink is sent from the first common liquid chamber to the second common liquid chamber via the plurality of individual channels, thereby enabling to circulate the ink inside the head.

The nozzle is arranged at a mid-point (mid-course) of each individual channel. Each individual channel includes a lust channel extended in a first direction which is an in-plane direction of a nozzle surface, a second channel which connects the pressure chamber and the first channel, and a third channel which is located on an opposite side of the second channel with the nozzle sandwiched between the second channel and the third channel in the first direction, and which is connected to the first channel. A flow of the ink in the first direction which is the in-plane direction of the nozzle surface is generated in the first channel, by the ink circulated inside the head. By the flow of the ink, it is possible to drain air bubbles entered through the nozzle or thickened ink that has dried, from the individual channel toward the second common liquid chamber.

SUMMARY

In the abovementioned ink-jet recording head, the first channel having the nozzle arranged mid-way is extended linearly along the first direction. Consequently, the flow of ink generated inside the first channel is linear along the first direction. At this time, a flow rate (flow velocity) of the ink is the maximum at a central portion in a width direction of the first channel, and becomes smaller toward an end portion in the width direction. Therefore, it is not possible to remove adequately the thickened ink at the end portion of the nozzle.

An object of the present teaching is to provide a liquid discharging head which enables to remove assuredly the thickened ink at the end portion of the nozzle.

According to an aspect of the present disclosure there is provided a liquid discharging head including:

a plurality of individual channels;

a first common liquid chamber provided commonly for the individual channels; and a second common liquid chamber provided commonly for the individual channels, wherein liquid is supplied from the first common liquid chamber to the individual channels and the liquid flows into the second common liquid chamber from the individual channels, wherein each of the individual channels has:

a pressure chamber;

a first channel;

a nozzle connected to the first channel and configured to discharge the liquid;

a second channel separated from the nozzle in a first direction and connecting the pressure chamber and the first channel, the first direction being a direction along a nozzle surface, of the liquid discharging head, in which the nozzle is opened; and a third channel connected to the first channel on a side opposite to the second channel in the first direction with the nozzle sandwiched between the third channel and the second channel, and wherein the first channel is bent to be convex to one side in a second direction, which is along the nozzle surface and orthogonal to the first direction, and a flowing direction of the liquid flowing through the first channel is bent to be convex to the one side in the second direction.

According to the liquid discharging head of the present disclosure, the flowing direction of the liquid flowing through the first channel is bent to be convex to one side in the second direction. Therefore, as compared to a case in which the flowing direction of the liquid flowing through the first channel is linear, it is possible to increase the flow rate of the liquid at an end portion, of the first channel, on one side in the second direction. Accordingly, it is possible to remove assuredly a thickened ink at an end portion of the nozzle connected to the first channel.

DETAILED DESCRIPTION

An embodiment of the present disclosure will be described below.

<Overall Configuration of Printer>

Figure 1:
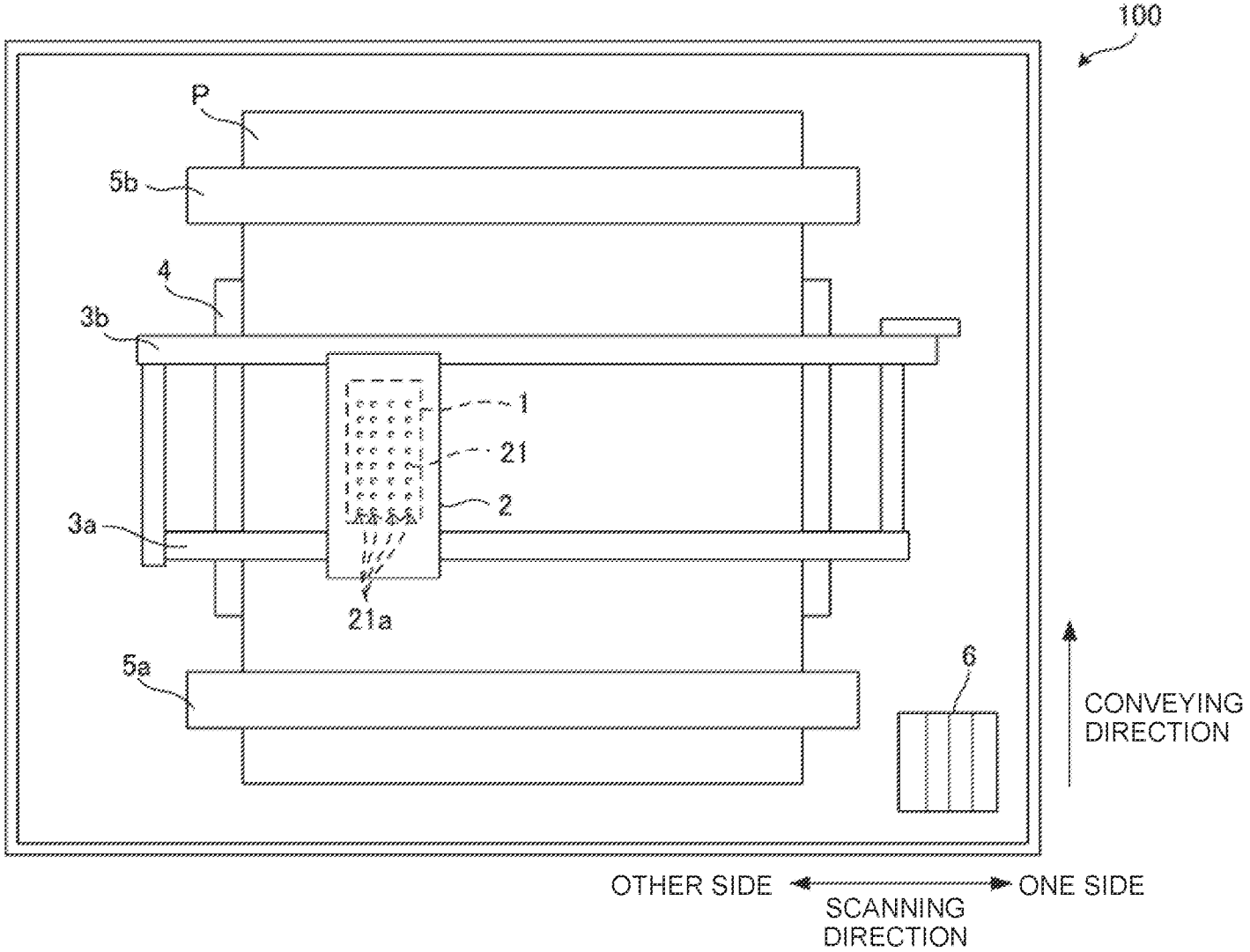
FIG. 1 is a plan view of a printer which includes an ink-jet head according to an embodiment of the present disclosure.

As depicted in FIG. 1, a printer 100 according to the present embodiment includes an ink-jet head 1 ("liquid discharging head" of the present disclosure), a carriage 2, guide rails 3*a* and 3*b*, a platen 4, conveying rollers 5*a* and 5*b*, and an ink tank 6.

The carriage 2 is supported by the two guide rails 3*a* and 3*b* extended in a scanning direction (leftward-rightward direction of FIG. 1) along a horizontal direction, and moves in the scanning direction along the guide rails 3*a* and 3*b*. The ink-jet head 1 is mounted (installed) on the carriage 2, and moves in the scanning direction together with the carriage 2. In the description below, a rightward side in FIG. 1 of the scanning direction is let to be "one side" and a leftward side in FIG. 1 is let to be "the other side".

Inks of four colors, black, yellow, cyan, and magenta are supplied to the ink-jet head 1 from the ink tank 6 via tubes not depicted in the diagram. The ink-jet head 1 discharges inks from (through) a plurality of nozzles 21 formed in a nozzle surface 11*y* (refer to FIG. 3 and FIG. 4). The nozzle surface 11*y* forms a lower surface of the ink-jet head 1.

The plurality of nozzles 21 forms a nozzle row 21*a* along a conveying direction (a direction directed upward from a lower side of FIG. 1) which is orthogonal to the scanning direction in a plan view. The inkjet head 1 has four nozzle rows 21*a* arranged side-by-side in the scanning direction. The inks of black, yellow, cyan, and magenta are discharged from the four nozzle rows 21*a* in order from a right side in FIG. 1. The ink-jet head 1 will be described later in detail.

The platen 4 is arranged face-to-face with the nozzle surface 11*y* of the ink-jet head 1, and is extended over an entire length of a recording paper P in the scanning direction. The platen 4 supports the recording paper P from below. The conveying rollers 5*a* and 5*b* are arranged at an upstream side and a downstream side respectively of the carriage 2 in the conveying direction, and convey the recording paper P in the conveying direction.

The printer 100 carries out printing on the recording paper P by carrying out a conveying processing and a scanning processing alternatively. Here, the conveying processing is a processing of conveying the recording paper P by a predetermined distance in the conveying direction by the conveying rollers 5*a* and 5, and the scanning processing is a processing of making discharge the inks from the plurality of nozzles while moving the carriage 2 in the scanning direction. In other words, the printer 100 is of a serial type. In the description below, a direction orthogonal to both the scanning direction and the conveying direction is an up-down direction.

<Ink-Jet Head 1>

Figure 2:
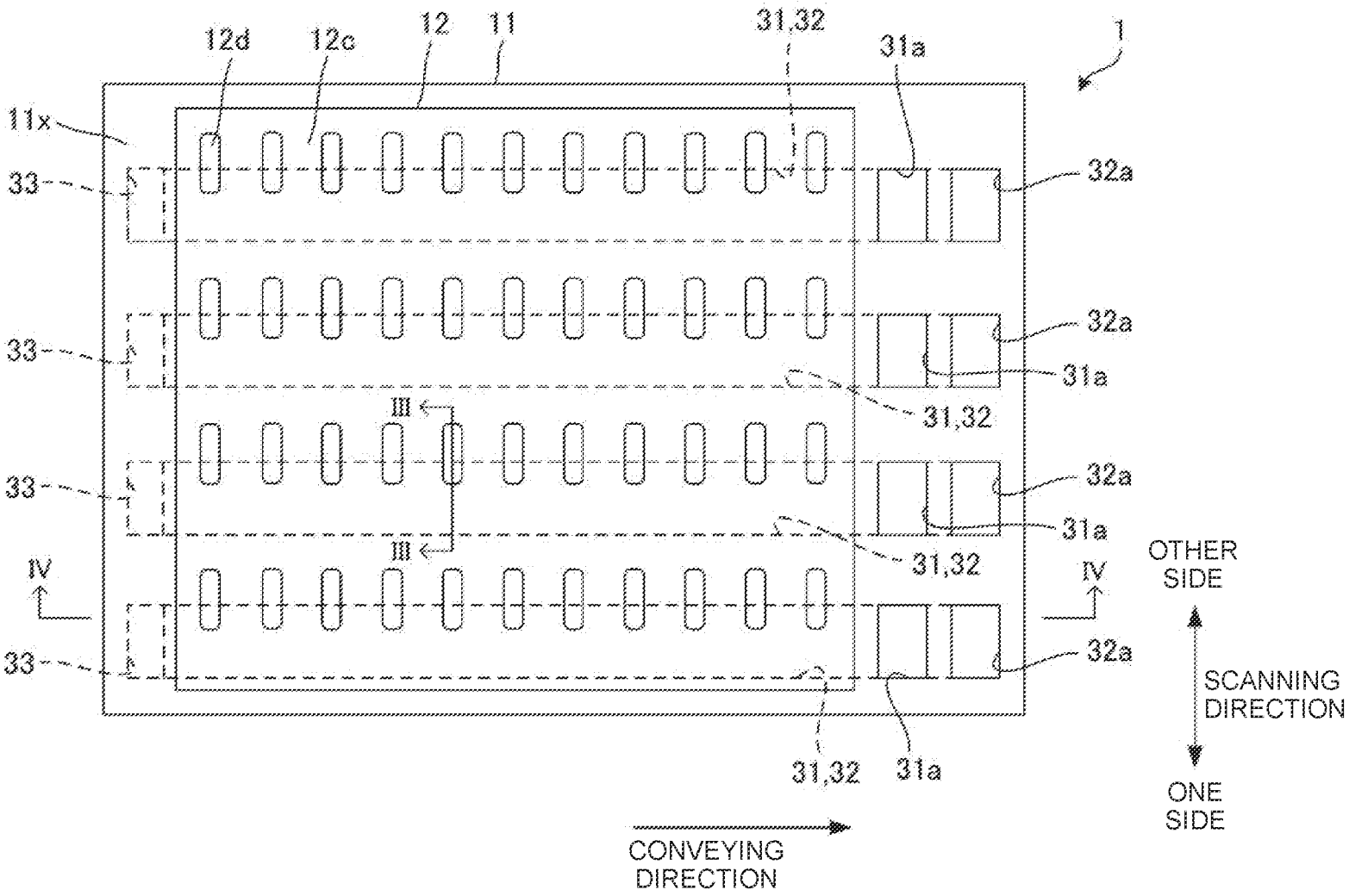
FIG. 2 is a plan view of the ink-jet head depicted in FIG. 1.

Next, a configuration in detail of the ink-jet head 1 will be described below while referring to FIG. 2 to FIG. 4. Note that, the scanning direction corresponds to the "first direction" of the present disclosure, the conveying direction corresponds to the "second direction" of the present disclosure, and the up-down direction corresponds to the "third direction" of the present disclosure. As depicted in FIG. 2, the ink-jet head 1 has a rectangular shape longer in the conveying direction in a top view. The ink-jet head 1 includes a channel unit 11 and a piezoelectric actuator 12.

Figure 3:
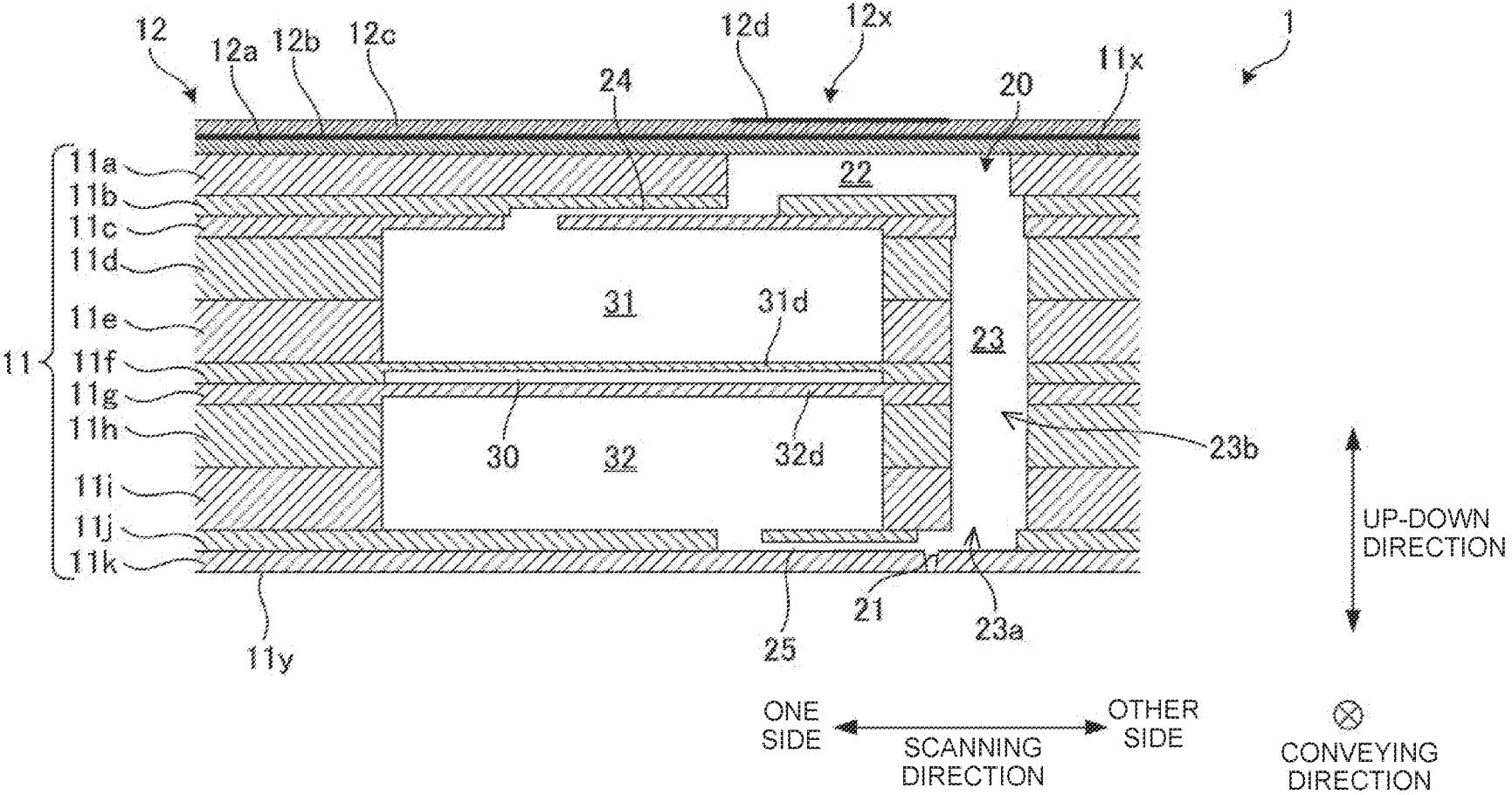
FIG. 3 is a cross-sectional view of the ink-jet head along a line III-III in FIG. 2.
Figure 4:
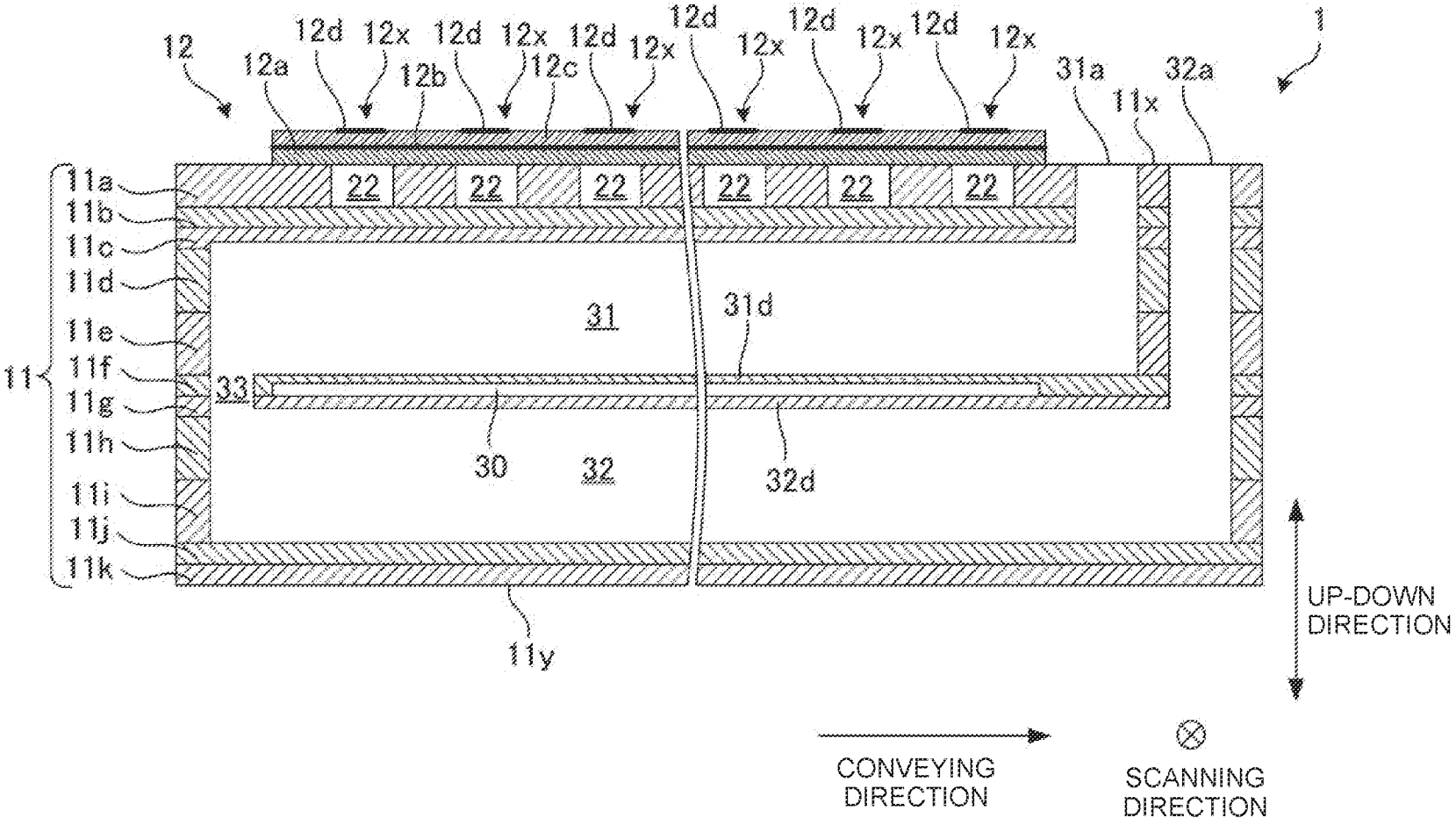
FIG. 4 is a cross-sectional view of the ink-jet head along a line IV-IV in FIG. 2.

The channel unit 11, as depicted in FIG. 3 and FIG. 4, is constituted by 11 plates 11*a* to 11*k* stacked in the up-down direction and stuck to one another. A plurality of individual channels 20, a supply manifold 31 (the "first common liquid chamber" of the present disclosure), a return manifold 32 (the "second common liquid chamber" of the present disclosure), and connecting channel 33 are formed in the channel unit 11. Note that, in FIG. 2, the individual channels 20 are omitted. Through holes and recesses constituting these individual channels 20, the supply manifold 31, the return manifold 32, and the connecting channel 33 are formed in each of the plates 11*a* to 11*k*.

As depicted in FIG. 2, four supply manifolds 31 and four return manifolds 32 are formed. Both the supply manifolds 31 and the return manifolds 32 are extended along the conveying direction. The four supply manifolds 31 are arranged side-by-side at an equal interval in the scanning direction. Even the four return manifolds 32 are arranged side-by-side at an equal interval in the scanning direction. As depicted in FIG. 3 and FIG. 4, the return manifolds 32 are located at a lower side of the supply manifolds 31. The four return manifolds 32 overlap with the four supply manifolds 31 in the up-down direction. Inks of black, yellow, cyan, and magenta colors flow into the four supply manifolds 31 and the four return manifolds 32 respectively.

As depicted in FIG. 4, an end portion at an upstream side in the conveying direction of the supply manifold 31 and an end portion at an upstream side of the conveying direction of the return manifold 32 are connected by the connecting channel 33.

The supply manifold 31 communicates with the ink tank 6 via a supply port 31*a* provided at an end portion at a downstream side of the conveying direction. Moreover, the return manifold 32 communicates with the ink tank 6 via a return port 32*a* provided at an end portion at a downstream side of the conveying direction. The supply port 31*a* and the return port 32*a* open on an upper surface 11*x* of the channel unit 11.

As depicted in FIG. 3, each individual channel 20 has the nozzle 21. The pair of supply manifold 31 and the return manifold 32 arranged up and down is provided commonly for the plurality of nozzles 21 in one nozzle row 21*a* (in other words, commonly for the plurality of individual channels 20 corresponding to one nozzle row 21*a*) (refer to FIG. 1). As depicted in FIG. 3, each individual channel 20 is located on the other side of the supply manifold 31 and the return manifold 32 to which the individual channel 20 is connected, in the scanning direction.

The ink in the ink tank 6 is fed to the supply manifold 31 via the supply port 31*a* by a pump which is not depicted in the diagram. The ink fed to the supply manifold 31 is supplied to each individual channel 20 while moving in (through) the supply manifold 31 from the downstream side toward the upstream side of the conveying direction (refer to FIG. 3). The ink flowed out from each individual channel 20 flows into the return manifold 32. Moreover, the ink that has reached an end portion of the upstream side of the conveying direction in the supply manifold 31 passes through the connecting channel 33 and flows into the return manifold 32. The ink flowed into the return manifold 32 moves through (inside) the return manifold 32 from the upstream side toward the downstream side of the conveying direction and is returned to the ink tank 6 via the return port 32*a*.

As depicted in FIG. 3 and FIG. 4, the supply manifold 31 is constituted by a recess formed in a lower surface of the plate 11*c* and a through hole cut through the plate 11*d* and the plate 11*e*. The return manifold 32 is constituted by a recess formed in a lower surface of the plate 11*g* and a through hole cut through the plate 11*h* and the plate 11*i*.

A damper chamber 30 is provided between the supply manifold 31 and the return manifold 32 in the up-down direction. The damper chamber 30 is constituted by a recess formed in a lower surface of the plate 11*f*. A bottom portion of the recess in the plate 11*f* functions as a damper film (damper membrane) 31*d* of the supply manifold 31. A bottom portion of the recess in the plate 11*g* functions as a damper film (damper membrane) 32*d* of the return manifold 32.

Each individual channel 20, as depicted in FIG. 3, includes the nozzle 21, the pressure chamber 22, the connecting channel 23 which consists of a first channel 23*a* and a second channel 23*b*, an inflow channel 24, and an outflow channel 25 (the "third channel" of the present disclosure).

The nozzle 21 is constituted by a through hole cut through the plate 11*k*, and opens on the nozzle surface 11*y* which constitutes the lower surface of the channel unit 11. In other words, the nozzle 21 is extended along the up-down direction.

The pressure chamber 22 is constituted by a through hole cut through the plate 11*a*, and opens on the upper surface of the channel unit 11. The inflow channel 24 is connected to an end portion of the pressure chamber 22, on one side of the scanning direction. The connecting channel 23 is connected to an end portion of the pressure chamber 22, on the other side of the scanning direction.

The connecting channel 23 connects the nozzle 21 and the pressure chamber 22. The first channel 23*a* of the connecting channel 23 is constituted by a through hole which is cut through the plate 11*j*. The first channel 23*a* overlaps with the nozzle 21 when viewed from a top. In other words, the nozzle 21 is connected to the first channel 23*a* at a position between both ends of the first channel 23*a*. The second channel 23*b* of the connecting channel 23 is constituted by a through hole cut through the plates 11*b* to 11*i*, and is extended in the up-down direction. The second channel 23*b* is separated apart (isolated) from the nozzle 21 in the scanning direction, and connects the pressure chamber 22 and the first channel 23*a*. The second channel 23*b* is located on an opposite side of the nozzle 21 in the up-down direction with the first channel 23*a* sandwiched between the second channel 23*b* and the nozzle 21. Details of the connecting channel 23 will be described later.

The inflow channel 24 connects the supply manifold 31 and the pressure chamber 22. The inflow channel 24 is constituted by a recess formed in the lower surface of the plate 11*b*, a through hole which is located at an end portion on the other side of the scanning direction of the recess, and a through hole cut through the plate 11*c*. More elaborately, the inflow channel 24 is connected to the pressure chamber 22 by the through hole formed in the plate 11*b*. Moreover, the inflow channel 24 is connected to the supply manifold 31 by a through hole cut through the plate 11*c*. The inflow channel 24 has a cross-sectional area of a surface orthogonal to the scanning direction (flowing direction of ink) smaller than the pressure chamber 22, and functions as a throttle channel.

The outflow channel 25 connects the first channel 23*a* of the connecting channel 23 and the return manifold 32. The outflow channel 25 is connected to the first channel 23*a* on an opposite side of the second channel 23*b* in the scanning direction with the nozzle 21 sandwiched between the outflow channel 25 and the first channel 23*a*. The outflow channel 25 is constituted by a recess formed in a lower surface of the plate 11*j* and a through hole located at an end portion of a one side of the scanning direction of the recess. The through hole in the plate 11*j* which constitutes the outflow channel 25 overlaps with the return manifold 32 in the up-down direction. An end portion of the outflow channel 25, on the other side of the scanning direction, is connected to the first channel 23*a* of the connecting channel 23. The outflow channel 25 has a cross-sectional area of a surface orthogonal to the direction of flow of ink smaller than the first channel 23*a* of the connecting channel 23, and functions as a throttle channel.

An ink supplied to each individual channel 20 from the supply manifold 31 flows into the pressure chamber 22 through the inflow channel 24, and upon moving substantially horizontally through the pressure chamber 22, flows into the connecting channel 23. The ink flowed into the connecting channel 23, upon moving downward through the second channel 23*b*, is poured into the first channel 23*a* which is spread through a horizontal surface. A part of the ink poured into the first channel 23*a* is discharged through the nozzle 21, and the remaining ink, upon passing through the outflow channel 25, flows into the return manifold 32.

By circulating the ink between the ink tank 6 and the channel unit 11, removal of air and prevention of thickening of ink in the return manifold 32 and the supply manifold. 31 formed in the channel unit 11, and moreover, in the individual channel 20, are realized. Moreover, in a case in which, the ink contains a sedimentation component (a component which may be formed as a sedimentation. Such as pigments), such component is agitated (stirred) and the sedimentation is prevented.

The piezoelectric actuator 12, as depicted in FIG. 3 and FIG. 4, includes in order from below, a vibration plate 12*a*, a common electrode 12*b*, a piezoelectric layer 12*c*, and a plurality of individual electrodes 12*d*.

The vibration plate 12*a* is arranged on the upper surface 11*x* of the channel unit 11. The common electrode 12*b*, the piezoelectric layer 12*c*, and the individual electrodes 12*d* are stacked in order from below in an area on the upper surface of the vibration plate 22*a*, opposite to (facing) the plurality of pressure chambers 22. The vibration plate 12*a*, the common electrode 12*b*, and the piezoelectric layer 12*c* are arranged to be spread over the plurality of pressure chambers 22. The individual electrode 12*d* is provided for each pressure chamber 22, and overlaps with the pressure chamber 22 when viewed from the top.

The common electrode 12*b* and the plurality of individual electrodes 12*d* are connected to a driver IC, which is not depicted in the diagram, via a wire member which is not depicted in the diagram. The driver IC, while maintaining an electric potential of the common electrode 12*b* to a ground electric potential, changes an electric potential of the individual electrode 12*d*. Accordingly, a portion of the vibration plate 12*a* and the piezoelectric layer 12*c*, between the individual electrode 12*d* and the pressure chamber 22 (actuator 12*x*) is deformed to be a projection toward the pressure chamber 22. Due to the deformation, a volume of the pressure chamber 22 becomes small, and a pressure on the ink inside the pressure chamber 22 rises, and the ink is discharged through the nozzle 21 communicating with the pressure chamber 22. In other words, the piezoelectric actuator 12 has a plurality of actuators 12*x* corresponding to the respective pressure chambers 22.

<Connecting Channel 23>

Next, the connecting channel 23 will be described below in further detail while referring to FIG. 5 and FIG. 6. Note that, FIG. 6 is a plan view of the plate 11*j* in which the first channel 23*a* of the connecting channel 23 is formed, and the second channel 23*b* of the connecting channel 23 and the nozzle 21 are indicated by dashed lines.

Figure 5:
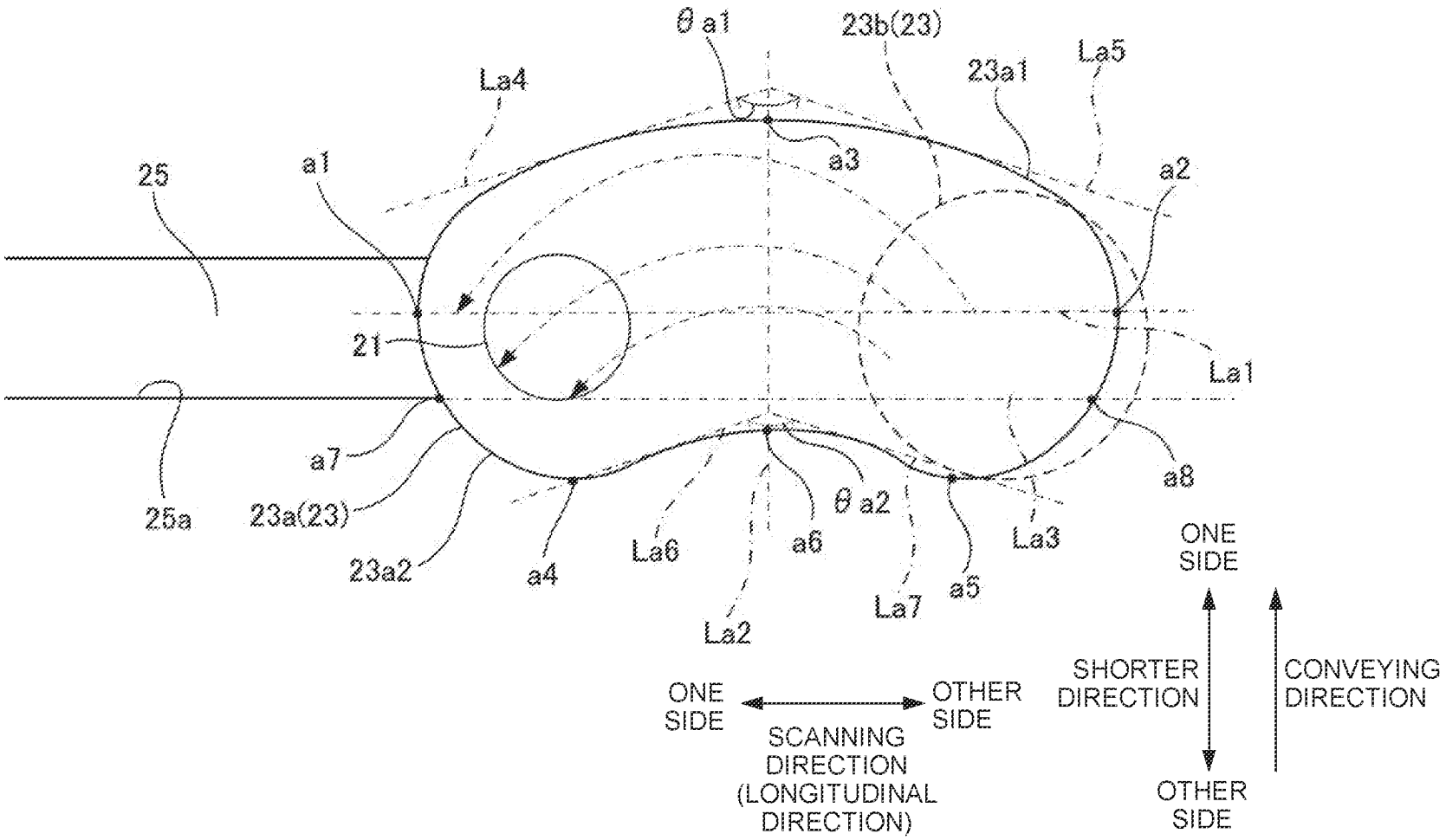
FIG. 5 is a diagram for describing a shape of a connecting channel depicted in FIG. 3.
Figure 6:
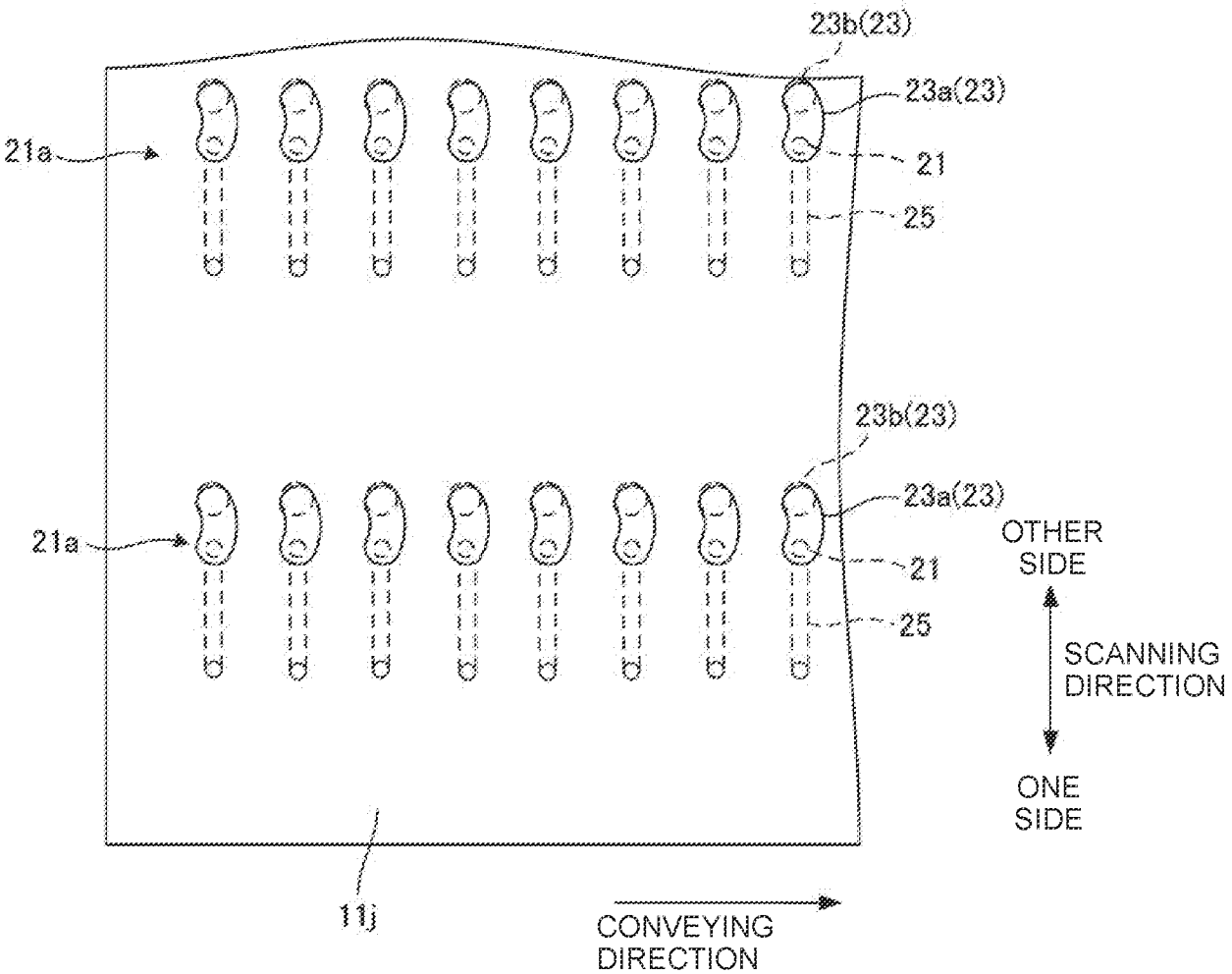
FIG. 6 is a plan view of a plate in which a first channel of the connecting channel depicted in FIG. 3 is formed.

As depicted in FIG. 5, the outflow channel 25 is connected to an end portion of the first channel 23*a* of the connecting channel 23, on one side in the scanning direction. The first channel 23*a* is bent to be convex toward the downstream side of the conveying direction in a horizontal surface (plane).

Note that, "convex toward the downstream side of the conveying direction" means the following case. Namely, under a condition that an end portion of the first channel 23*a* on an opposite side of the outflow channel 25 in the scanning direction (an end portion on the other side) is a base (reference), there is a portion which is projected (which sticks out) toward the downstream side of the conveying direction from the base. Moreover, a direction in which the first channel 23*a* is projected from the end portion of the other side is defined as "a bending direction of the first channel". In other words, in the present embodiment, the bending direction of the first channel is the downstream side of the conveying direction.

Here, let two different points on a circumference (periphery) of the first channel 23*a* in the connecting channel 23 in a plan view, for which a line segment joining the two points becomes the longest, be points a1 and a2. Moreover, let a direction parallel to a virtual straight line La1 passing through the points a1 and a2 in a plan view be a longitudinal direction, and a direction orthogonal to the longitudinal direction be a shorter direction. In the present embodiment, the longitudinal direction is a direction parallel to the scanning direction, and the shorter direction is a direction parallel to the conveying direction. It is possible to divide the circumference of the first channel 23*a* into a first portion 23*a*1 and a second portion 23*a*2 connecting the two points a1 and a2. As depicted in FIG. 5, the first portion 23*a*1 is located on one side of the virtual straight line La1 in the shorter direction, and the second portion 23*a*2 is located on the other side of the virtual straight line La2 in the shorter direction.

The first portion 23*a*1 of the circumference of the first channel 23*a* has a convex shape protruded toward the one side in the shorter direction as a whole. Let an apex of the first portion 23*a*1 having a convex shape be a point a3. In the second portion 23*a*2 of the circumference of the first channel 23*a*, a convex portion protruding toward the one side of the shorter direction is located between the two convex portions protruding toward the other side of the shorter direction. Let apex of the two convex portions protruding toward the other side of the shorter direction of the second portion 23*a*2 be points a4 and a5 respectively, and let an apex of the convex portion protruding toward the one side of the shorter direction of the second portion 23*a*2 be a point a6. At this time, let a position of a virtual straight line La2 passing through the point a3 and the point a6 be a bending position of the first channel 23*a*. The first channel 23*a* has a symmetrical shape with respect to the virtual straight line La2.

Let a connecting portion at which a wall surface 25*a* (an exemplary "second wall surface") on the upstream side of the conveying direction defining the outflow channel 25 is connected, on a wall surface defining the first channel 23*a* be a point a7. Moreover, let a straight line extended along the scanning direction passing through a point a7 be a virtual straight line La3. At this time, the virtual straight line La3 does not intersect the wall surface defining the first channel 23*a* at a position other than positions at two ends of the first channel 23*a* on the virtual straight line La3 (positions indicated by a point a7 and a point a8 in FIG. 5).

Let a tangential line at a central position in a longitudinal direction of the point a1 and the point a3, on the first portion 23*a*1 of the circumference of the first channel 23*a* in a top view, be a virtual straight line La4. Moreover, let a tangential line at a central position in a longitudinal direction of the point a2 and the point a3 on the first portion 23*a*1 of the circumference of the first channel 23*a* in the top view, be a virtual straight line La5. Note that, both the virtual straight line La4 and the virtual straight line La5 are half lines with a mutual point of intersection as an end point. At this time, an angle made by the virtual straight line La4 and the virtual straight line La5 is a first bending angle θa1 of the first channel 23*a*. The (first) bending angle θa1 is not smaller than 90°.

Let a tangential line at a central position in a longitudinal direction of the point a4 and the point a6 on the second portion 23*a*2 of the circumference of the first channel 23*a* in a top view, be a virtual straight line La6. Moreover, let a tangential line at a central position in a longitudinal direction of the point a5 and the point a6 on the second portion 23*a*2 of the circumference of the first channel 23*a* in the top view; be a virtual straight line La7. Note that, both the virtual straight line La6 and the virtual straight line La7 are half lines with a mutual point of intersection as an end point. At this time, an angle made by the virtual straight line La6 and the virtual straight line La7 is a second bending angle θa2 of the first channel 23*a*. The (second) bending angle θa2 is not smaller than 90°.

As depicted in FIG. 5, the nozzle 21 is connected to a center in the conveying direction of the first channel 23*a*. The nozzle 21 does not overlap with the second channel 23*b* of the connecting channel 23 in the top view. The nozzle 21 is located on the outflow channel 25 side of a bending position of the first channel 23*a* (position of the virtual straight line La2) in the top view. The second channel 23*b* of the connecting channel 23 is located on an opposite side of the nozzle 21 with the bending position of the first channel 23*a* (position of the virtual straight line La2) sandwiched between the second channel 23*b* and the nozzle 21 in the top view As mentioned above, the first channel 23*a* is bent to be convex toward downstream of the conveying direction. Therefore, the flowing direction of the ink pouring into the first channel 23*a* through the second channel 23*b*, and directed toward the outflow channel 25 is bent to be convex toward downstream of the conveying direction as depicted by alternate dotted and dashed lines in FIG. 5. Accordingly, the flow rate of the ink inside the first channel 23*a* becomes gradually faster in the downstream side of the conveying direction.

As depicted in FIG. 6, the plurality of first channels 23*a* of the connecting channel 23 is formed in the plate 11*j*. The plurality of first channels 23*a* to which the plurality of nozzles 21 in one nozzle row 21*a* is connected respectively is arranged in a row along the conveying direction. A bending direction of the plurality of first channels 23*a* arranged in a row is a same direction (downstream side of the conveying direction). Moreover, a bending direction of the plurality of first channels 23*a* is a same direction for the plurality of nozzle rows 21*a*.

As mentioned above, the ink-jet head 1 of the abovementioned embodiment includes the plurality of individual channels 20 to which the ink is supplied from the supply manifold 31, and which returns a part of the ink supplied from the supply manifold 31 to the return manifold 32. Each individual channel 20 has the pressure chamber 22, the nozzle 21 which discharges the ink, the connecting channel 23 which connects the pressure chamber 22 and the nozzle 21, and the outflow channel 25 which is connected to the return manifold 32. The connecting channel 23 is constituted by the first channel 23*a* and the second channel 23*b*. The nozzle 21 is connected mid-way of the first channel 23*a*. The second channel 23*b* is separated (apart) from the nozzle 21 in the scanning direction, and connects the pressure chamber 22 and the first channel 23*a*. The outflow channel 25 is connected to the first channel 23*a* on the opposite side of the second channel 23*b* in the scanning direction with the nozzle sandwiched between the second channel 23*b* and the outflow channel 25. The first channel 23*a* is bent to be convex to one side in the conveying direction which is orthogonal to the scanning direction, and the flowing direction of the ink flowing through the first channel 23*a* is bent to be convex to one side in the conveying direction.

According to the abovementioned configuration, the flowing direction of the ink in the first channel 23*a* is bent (curved) to be convex to one side in the conveying direction. Therefore, as compared to a case in which the flowing direction of the liquid through the first channel 23*a* is linear, it is possible to increase the flow rate of the liquid at an end portion of one side of the conveying direction in the first channel 23*a*. Consequently, it is possible to remove assuredly the thickened ink at an end portion of the nozzle 21 connected to the first channel 23*a*.

Moreover in the ink-jet head of the abovementioned embodiment, the first channel 23*a* is bent in the horizontal surface (horizontal plane). Consequently, it is possible to smoothen the flow of the ink through the first channel 23*a*, and to make the turbulent flow unsusceptible to occur.

Furthermore, in the inkjet head 1 of the abovementioned embodiment, the nozzle is connected to the center of the first channel 23*a* in the conveying direction. Consequently, it is possible to remove assuredly the thickened ink at the end portion of the nozzle 21.

Additionally, in the ink-jet head 1 of the abovementioned embodiment, both the nozzle 21 and the second channel 23*b* are extended in the up-down direction. Moreover, the second channel 23*b* is located on the opposite side of the nozzle 21 in the up-down direction, with the first channel sandwiched between the nozzle 21 and the second channel 23*b*. Furthermore, the nozzle 21 does not overlap with the second channel 23*b* when viewed from the top. Consequently, it is possible to prevent an air that has entered into the first channel 23*a* through the nozzle 21 from being pushed into the nozzle 21 by the flow of the ink from the second channel 23*b* to the first channel 23*a* (the flow along the up-down direction).

Furthermore, in the ink-jet head 1 of the abovementioned embodiment, the nozzle rows 21*a* are arranged side-by-side in the scanning direction, and each nozzle row 21*a* is formed by the plurality of nozzles 21 aligned in the conveying direction. The bending direction of the first channel 23*a* to which each nozzle 21 is connected is same for the plurality of nozzle rows 21*a*. Consequently, the flowing direction of the ink flowing through the first channel 23*a* connected to each nozzle 21 becomes same for the plurality of nozzle rows 21*a*. Therefore, it is possible to match (make uniform) the direction of flight-bending of the ink discharged from each nozzle 21.

Moreover, in the ink-jet head 1 of the abovementioned embodiment, an area of a cross section of the outflow channel 25, orthogonal to the flowing direction of the ink is smaller than an area of the cross section of the first channel 23*a*, orthogonal to the flowing direction of the ink. Consequently, the pressure which discharges the ink by drive of the piezoelectric actuator 12 is unsusceptible to escape to the outflow channel 25, and it is possible to jet the ink assuredly through the nozzles 21.

In addition, in the ink-jet head 1 of the abovementioned embodiment, the outflow channel 25 is extended along the scanning direction. Moreover, the virtual straight line La3 does not intersect the wall surface defining the first channel 23*a* at a position other than positions at two ends (the point a7 and the point a8) of the first channel 23*a* on the virtual straight line La3.

Here, in a case in which the point a6 of the circumference of the second portion 23*a*2 in the first channel 23*a* (refer to FIG. 5) is located on the downstream side of the conveying direction of the virtual straight line La3, the virtual straight line La3 intersects the side wall defining the first channel 23*a* except at the point a7 and the point a8. In this case, a stagnation point is developed on one side of the point a6 in the scanning direction in the first channel 23*a*, in a portion on the upstream side of the conveying direction of the virtual straight line La3. In the abovementioned configuration, it is possible to make the stagnation point unsusceptible from being developed in the first channel 23*a*, and to make it easy to remove the air from the first channel 23*a*.

Moreover, in the inkjet head 1 of the abovementioned embodiment, both the bending angles θa1 and θa2 of the first channel 23*a* are not smaller than 90°. In a case in which the bending angle of the first channel 23*a* is an acute angle, preparing the first channel 23*a* is difficult, and a variation in a shape of the first channel 23*a* occurs for the plurality of individual channels 20. In the abovementioned configuration, it is possible to make the variation in the shape of the first channel 23*a* for the plurality of individual channels 20 unsusceptible to occur.

The embodiments of the present disclosure have been described heretofore with reference to the accompanying diagrams. However, specific configuration is not limited to the embodiments described. The scope of the present disclosure is indicated by the scope of the patent claims and not by the description of the embodiments above, and includes all modifications within limits and significance equivalent to the scope of the patent claims.

Figure 7:
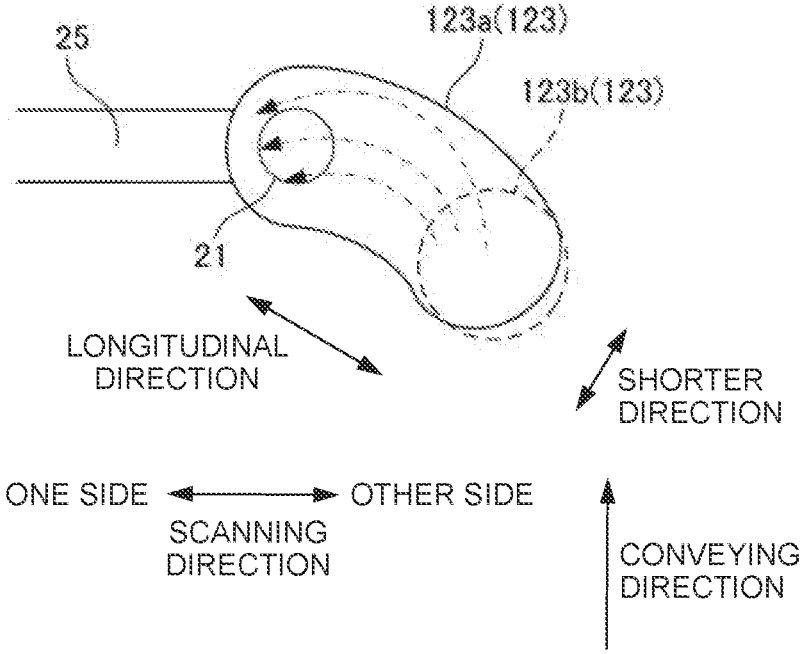
FIG. 7 is a diagram depicting a connecting channel according to a first modified example of the present disclosure.

In the abovementioned embodiments, the description of the case in which the longitudinal direction of the first channel 23*a* of the connecting channel 23 is a direction parallel to the scanning direction, and the shorter direction is a direction parallel to the conveying direction, has been made. However, the present disclosure is not restricted to the abovementioned case only. Here, in FIG. 7, a first channel 123*a* of a connecting channel 123 according to a first modified example of the abovementioned embodiment is depicted. As depicted in FIG. 7, the first channel 123*a* according to the present modified example has a same shape as the first channel 23*a* of the abovementioned embodiment, but a longitudinal direction thereof is inclined with respect to the scanning direction, and a shorter direction is inclined with respect to the conveying direction.

The first channel 123*a* is bent to be convex toward a downstream side of the conveying direction in a horizontal plane. In other words, the first channel 123*a*, with an end portion of the first channel 123*a* on an opposite side of a side to which the outflow channel 25 in the scanning direction is connected (an end portion on the other side) as a base, has a portion which is projected (which sticks out) toward the downstream side of the conveying direction from the end portion from the base. Moreover, as depicted by alternate dotted and dashed lines in FIG. 7, a flowing direction of the ink pouring into the first channel 123*a* through a second channel 123, and directed toward the outflow channel 25 bends to be convex toward downstream side in the conveying direction.

Furthermore, in the abovementioned embodiment, a case in which the first channel 23*a* is bend in the horizontal surface has been described. However, the present disclosure is not restricted to the case described above.

Figure 8:
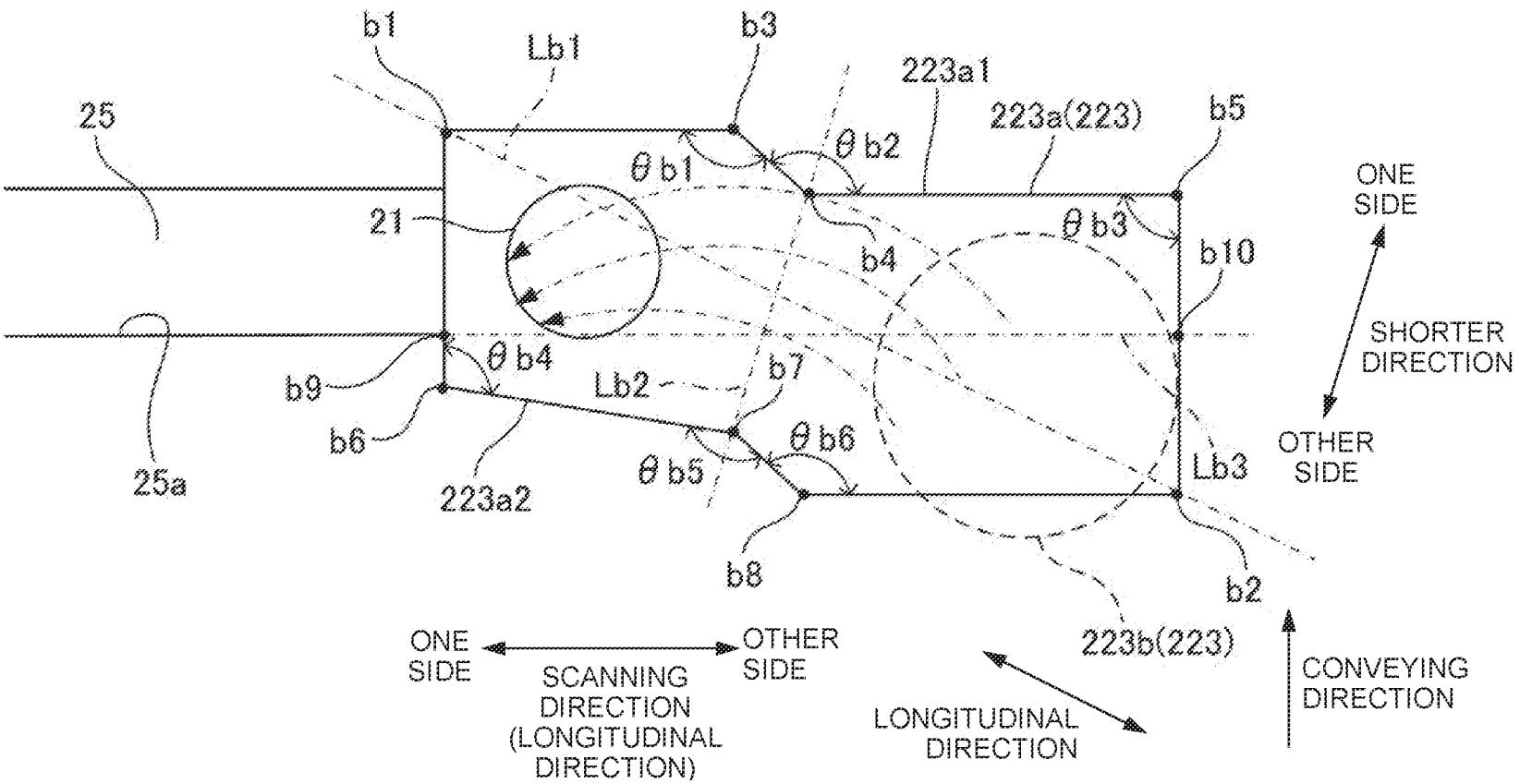
FIG. 8 is a diagram depicting a connecting channel according to a second modified example of the present disclosure.

Here, in FIG. 8, a first channel 223*a* of a connecting channel 223 according to a second modified example of the abovementioned embodiment is depicted. As depicted in FIG. 8, the first channel 223*a* is bent in a horizontal surface.

The first channel 223*a* is bent to be convex toward a downstream side in the conveying direction in the horizontal surface. In other words, the first channel 223*a*, with an end portion of the first channel 223*a* on an opposite side of a side to which the outflow channel 25 in the scanning direction is connected (an end portion on the other side) as a base, has a portion which is projected (which sticks out) toward the downstream side of the conveying direction from the base. Moreover, as depicted by alternate dotted and dashed lines in FIG. 8, a flowing direction of the ink pouring into the first channel 223*a* through a second channel 223*b*, and directed toward the outflow channel 25 bends to be convex toward the downstream side in the conveying direction.

Here, let two different points on a circumference of the first channel 223*a* in the connecting channel 223 in a plan view, for which, a line segment joining two points becomes the longest, be points b1 and b2. Moreover, let a direction parallel to a virtual straight line Lb1 passing through the points b1 and b2 in a plan view be a longitudinal direction, and a direction orthogonal to the longitudinal direction be a shorter direction.

In the present embodiment, the longitudinal direction is inclined with respect to the scanning direction, and the shorter direction is inclined with respect to the conveying direction. It is possible to divide the circumference of the first channel 223*a* into a first portion 223*a*1 and a second portion 223*a*2 connecting the two points b1 and b2. As depicted in FIG. 8, the first portion 223*a*1 is located on one side of the virtual straight line Lb1 in the shorter direction, and the second portion 223*a*2 is located on the other side of the virtual straight line Lb1 in the shorter direction.

The first portion 223*a*1 of the circumference of the first channel 223*a* is bent at three locations, that are, a point b3, a point b4, and a point b5. The second portion 223*a*2 of the circumference of the first channel 223*a* is bent at three locations, that are, a point b6, a point b7, and a point b8. Each of bending angles θb1, θb2, θb3, θb4, θb5, and θb6 at six bending positions of the point b3 to the point b8 is not smaller than 90°. Let a position of a virtual straight line Lb2 passing through the point b4 which is the middle bending position among the three bending positions of the first portion 223*a*1 and the point b7 which is the middle bending position among the three bending positions of the second portion 223*a*2 be a bending position of the first channel 223*a*.

The nozzle 21 is located on the outflow channel 25 side of the bending position (position of the virtual straight line Lb2) of the first channel 223*a* in the top view. The second channel 223*b* of the connecting channel 223 is located on an opposite side of the nozzle 21 with the bending position (position of the virtual straight line Lb2) of the first channel 223*a* sandwiched between the nozzle 21 and the second channel 223*b* in the top view. The nozzle 21 is connected to a center in the conveying direction of the first channel 23*a*. The nozzle 21 does not overlap with the second channel 223*b* of the connecting channel 223 in the top view.

Let a connecting location at which, a wall surface 25*a* on the upstream side of the conveying direction of the wall surface defining the outflow channel 25 is connected, to a wall surface defining the first channel 223*a* be a point b9. Moreover, let a straight line extended along the scanning direction, passing through the point b9 be a virtual straight line Lb3. At this time, the virtual straight line Lb3 does not intersect the wall surface defining the first channel 223*a* at a position other than positions at two ends of the first channel 223*a* on the virtual straight line Lb3 (positions indicated by the point b9 and a point b10 in FIG. 8).

Figure 9:
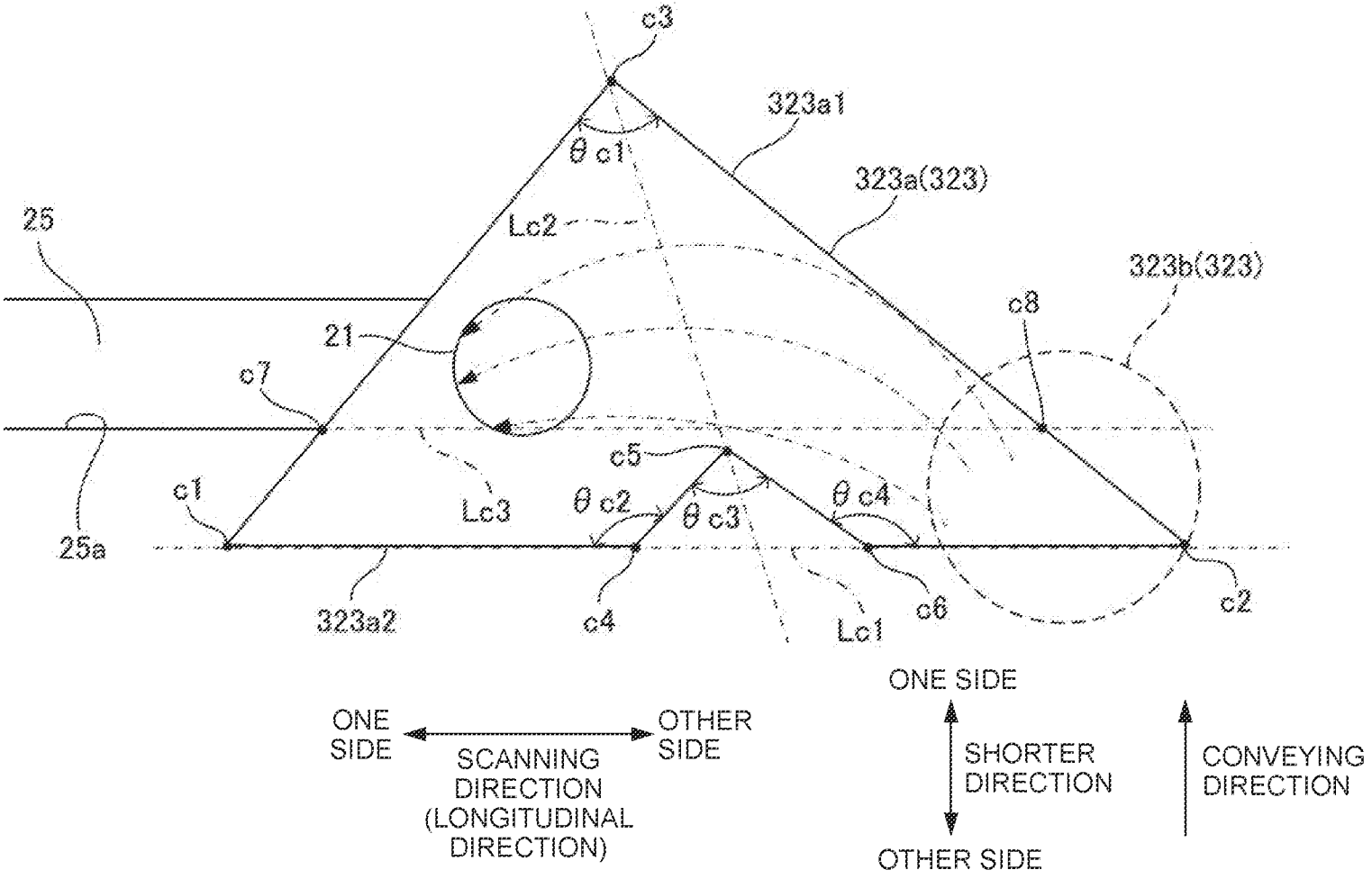
FIG. 9 is a diagram depicting a connecting channel according to a third modified example of the present disclosure.

Furthermore, a first channel 323*a* of a connecting channel 323 according to a third modified example of the abovementioned embodiment is depicted in FIG. 9. As depicted in FIG. 9, the first channel 323*a* is bent in a horizontal surface.

The first channel 323*a* is bent to be convex toward a downstream side in the conveying direction in the horizontal surface. In other words, the first channel 323*a*, with an end portion of the first channel 323*a* on an opposite side of a side to which the outflow channel 25 in the scanning direction is connected (an end portion on the other side) as a base, has a portion which is projected (which sticks out) toward the downstream side of the conveying direction from the base. Moreover, as depicted by alternate dotted and dashed lines in FIG. 9, a flowing direction of the ink pouring into the first channel 323*a* through a second channel 323*b*, and directed toward the outflow channel 25 bends to be convex toward the downstream side in the conveying direction.

Here, let two different points on a circumference of the first channel 323*a* in the connecting channel 323 in a plan view, for which, a line segment joining two points becomes the longest, be points c1 and c2. Moreover, let a direction parallel to a virtual straight line Lc1 passing through the points c1 and c2 in a plan view be a longitudinal direction, and a direction orthogonal to the longitudinal direction be a shorter direction, In the present embodiment, the longitudinal direction is parallel to the scanning direction, and the shorter direction is parallel to the conveying direction. It is possible to divide the circumference of the first channel 323*a* into a first portion 323*a*1 and a second portion 323*a*2, both connecting the two points c1 and c2. In other words, the first portion 323*a*1 is located on the downstream side of the conveying direction from the second portion 323*a*2.

The first portion 323*a*1 of the circumference of the first channel 323*a* is bent at a point c3. The second portion 323*a*2 of the circumference of the first channel 323*a* is bent at three locations, that are, a point c4, a point c5, and a point c6. Each of bending angles θc1, θc2, θc3, and θc4 at four bending positions of the points c3 to c6 is not smaller than 90°. Let a position of a virtual straight line Lc2 passing through the point c3 which is a bending position of the first portion 323*a*1 and the point c5 which is the middle bending position among the three bending positions of the second portion 323*a*2, be a bending position of the first channel 323*a*.

The nozzle 21 is located on the outflow channel 25 side of the bending position (position of the virtual straight line Lc2) of the first channel 323*a* in the top view. The second channel 323*b* of the connecting channel 323 is located on an opposite side of the nozzle 21 with the bending position (position of the virtual straight line Lc2) of the first channel 323*a* sandwiched between the nozzle 21 and the second channel 323*b* in the top view. The nozzle 21 is connected to a center in the conveying direction of the first channel 323*a*. The nozzle 21 does not overlap with the second channel 323*b* of the connecting channel 323 in the top view.

Let a connecting location at which a wall surface 25*a* on the upstream side of the conveying direction defining the outflow channel 25, is connected, on a wall surface defining the first channel 323*a*, be a point c7. Moreover, let a straight line extended along the scanning direction, passing through the point c7, be a virtual straight line Lc3. At this time, the virtual straight line Lc3 does not intersect the wall surface defining the first channel 323*a* except at positions at two ends of the first channel 323*a* on the virtual straight line Lc3 (positions indicated by the point c7 and a point c8 in FIG. 9).

Moreover, in the abovementioned embodiment, the case in which the nozzle 21 is connected to the middle of the first channel 323*a* in the conveying direction has been described. However, the present disclosure is not restricted to the abovementioned arrangement. In other words, the nozzle 21 may have been connected to the first channel 323*a* at the downstream side of the conveying direction, or may have been connected to the first channel 323*a* at the upstream side of the conveying direction.

Furthermore, in the abovementioned embodiment, the case in which, both the nozzle 21 and the second channel 23*b* are extended in the up-down direction, the direction in which the nozzle 21 is extended, and the direction in which the second channel 23*b* is extended, are parallel. However, the present disclosure is not restricted to such arrangement, and the nozzle 21 and the second channel 23*b* may have been extended in different directions.

Moreover, in the abovementioned embodiment, the case in which, the bending direction of the first channel 23*a* to which each nozzle 21 in the nozzle row 21*a* is connected is same for the nozzle rows 21*a*, has been described. However, the present disclosure is not restricted to such arrangement. The bending direction of the first channel 23*a* may be different for different nozzle rows 21*a*.

In addition, in the abovementioned embodiment, the case in which, the virtual straight line La3 which is a virtual straight line extended along the scanning direction, and. which passes through the connecting location (the point a7) at which the wall surface 25*a* on the upstream side of the conveying direction of the wall surface defining the outflow channel 25 is connected, on a wall surface defining the first channel 23*a* does not intersect the wall surface defining the first channel 23*a* at a position other than positions at the two ends of the first channel 23*a* on the virtual straight line La3, has been described. However, the present disclosure is not restricted to the abovementioned arrangement. The virtual straight line La3 may intersect the wall surface defining the first channel 23*a* located at the positions of the two ends of the first channel 23*a* on the virtual straight line La3.

Moreover, in the abovementioned embodiment, the case in which the bending angle of the first channel 23 is not smaller than 90° has been described. However, the bending angle of the first channel 23*a* may be smaller than 90°.

Furthermore, in the abovementioned embodiment, the case in which the nozzle 21 is located on the outflow channel 25 side of the position of bending of the first channel 23*a* in the top view, and the second channel 23*b* is located on the opposite side of the nozzle 21 with the bending position of the first channel 23*a* sandwiched therebetween has been described. However, the present disclosure is not restricted to such arrangement, and the nozzle 21 and the second channel 23*b* may have been located on the same side of the bending position of the first channel 23*a*.

In addition, in the abovementioned embodiment, the case in which the outflow channel 25 is connected to the end portion of the connecting channel 23, on one side of the scanning direction of the first channel 23*a*, has been described. However, the present disclosure is not restricted to such arrangement.

Figure 10:
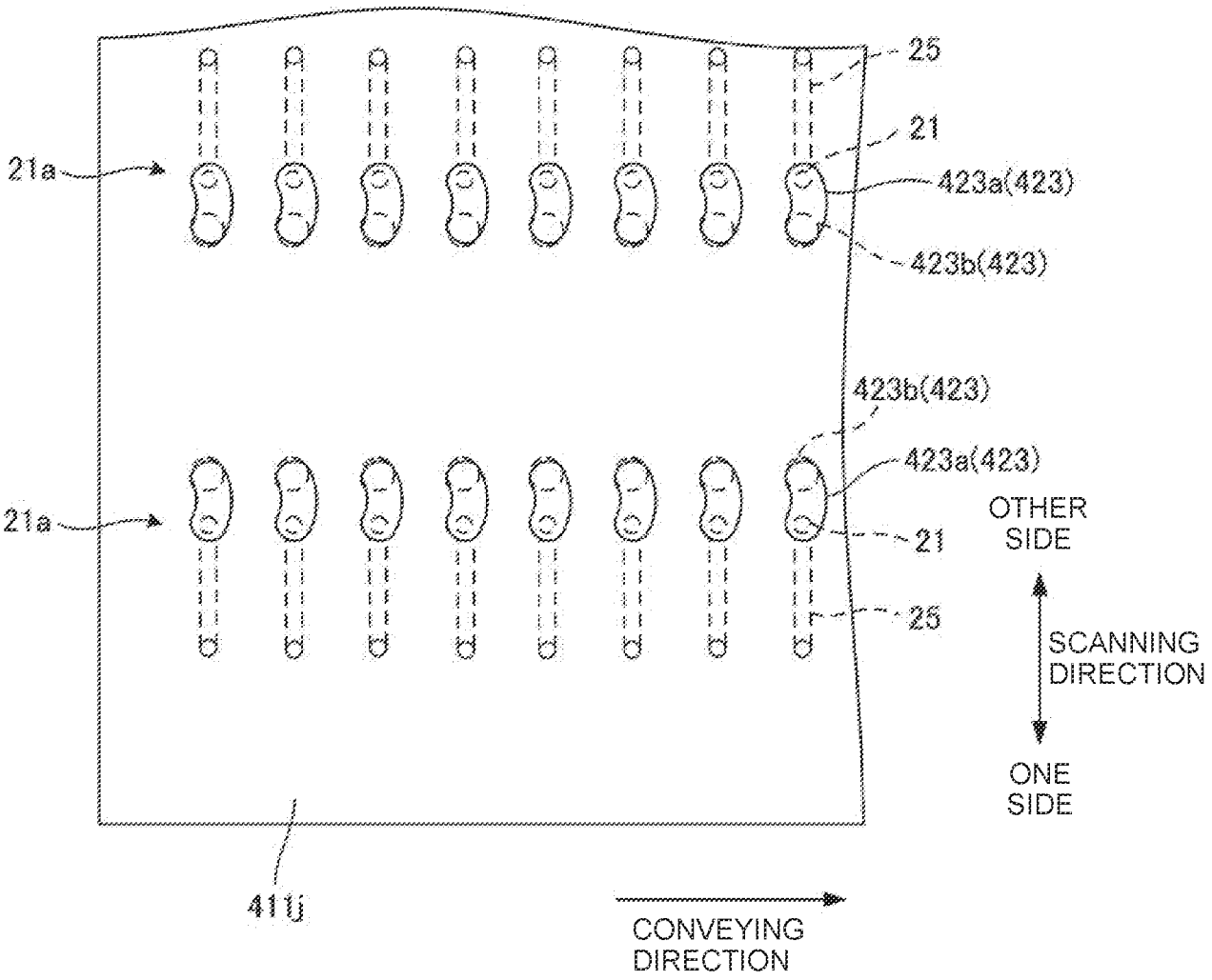
FIG. 10 is a plan view of a plate in which a first channel of a connecting channel according to a fourth modified example of the present disclosure is formed.

Here, a plate 411*j* in which a first channel 423*a* of a connecting channel 423 according to a fourth modified example of the abovementioned embodiment is depicted in FIG. 10. Note that, in FIG. 10, the nozzles 21 and the second channels 423*b* of the connecting channels 423 are depicted by broken lines. As depicted in FIG. 10, in the present modified example, a location at which the outflow channel 25 is connected to the first channel 423 to which each nozzle 21 in the nozzle row 21*a* is connected differs for (according to) the nozzle rows 21*a*.

In other words, the outflow channel 25 is connected to an end portion on the other side of the scanning direction of the first channel 423*a* to which each nozzle 21 in the nozzle row 21*a* located at an upper side in FIG. 10 is connected. Whereas, the outflow channel 25 is connected to one side of the scanning direction of the first channel 423*a* to which each nozzle 21 in the nozzle row 21*a* located at a lower side in FIG. 10 is connected. Note that, in the present modified example, a bending direction of the first channel 423*a* to which each nozzle 21 in the nozzle row 21*a* is connected is same for the nozzle rows 21*a*.

The actuator 12*x* is not restricted to an actuator of piezo type in which a piezoelectric element is used, and it may be an actuator of other type (such as a thermal type in which a heater element is used and an electrostatic type in which an electrostatic force is used).

A recording mode of the printer 100 is not restricted to a serial mode, and may be a line mode which is long in a direction of width of the recording paper P, and in which an ink is jetted from nozzles of a head having a position fixed.

A liquid jetted from the nozzles 21 is not restricted to an ink, and may be an arbitrary liquid (such as a process liquid (a treatment liquid) in which, components in ink are agglomerated or extracted (precipitated)). Moreover, a target to be jetted is not restricted to the recording paper P, and may be a cloth, a substrate etc.

The present disclosure is not restricted to a printer, and may be applicable to a facsimile, a copy machine, and a multifunction device. Moreover, the present disclosure is also applicable to a liquid discharging apparatus which is to be used for an application other than recording an image (such as a liquid discharging apparatus which forms an electroconductive pattern by discharging an electroconductive liquid on a substrate).

What is claimed is:

1. A liquid discharging head comprising:

a plurality of individual channels;

a first common liquid chamber provided commonly for the individual channels; and a second common liquid chamber provided commonly for the individual channels, wherein liquid is supplied from the first common liquid chamber to the individual channels and the liquid flows into the second common liquid chamber from the individual channels, wherein each of the individual channels has:

a pressure chamber;

a first channel:

a nozzle connected to the first channel and configured to discharge the liquid;

a second channel separated from the nozzle in a first direction and connecting the pressure chamber and the first channel, the first direction being a direction along a nozzle surface, of the liquid discharging head, in which the nozzle is opened; and a third channel connected to the first channel on a side opposite to the second channel in the first direction with the nozzle sandwiched between the third channel and the second channel, and wherein the first channel is bent to be convex to one side in a second direction, which is along the nozzle surface and orthogonal to the first direction, and a flowing direction of the liquid flowing through the first channel is bent to be convex to the one side in the second direction.

2. The liquid discharging head according to claim 1, wherein the first channel is curved in a surface parallel to the nozzle surface.

3. The liquid discharging head according to claim 1, wherein the first channel is bent in a surface parallel to the nozzle surface.

4. The liquid discharging head according to claim 1, wherein the nozzle is connected to a center of the first channel in the second direction.

5. The liquid discharging head according to claim 1, wherein the second channel is extended in a direction parallel to a direction in which the nozzle is extended, and is located on a side opposite to the nozzle in a third direction with the first channel sandwiched between the nozzle and the second channel, the third direction being a direction which is orthogonal to both the first direction and the second direction, and the nozzle does not overlap with the second channel when viewed from the direction in which the nozzle is extended.

6. The liquid discharging head according to claim 1, wherein the nozzle surface is formed with a plurality of nozzle rows arranged side-by-side in the first direction, each of the nozzle rows includes a plurality of nozzles aligned in the second direction, the nozzles including the nozzle, and a bending direction of the first channel to which the nozzle is connected is same for the nozzle rows.

7. The liquid discharging head according to claim 1, wherein an area of a cross section of the third channel is smaller than an area of a cross section of the first channel, the cross section of the third channel being orthogonal to a flowing direction of the liquid flowing through the third channel, the cross section of the first channel being orthogonal to the flowing direction of the liquid flowing through the first channel.

8. The liquid discharging head according to claim 1, wherein the third channel is extended in the first direction and defined by a first wall surface and a second wall surface facing each other in the second direction, the second, wall surface being positioned on the other side in the second direction with respect to the first wall surface, and a virtual straight line which is extended along the first direction does not intersect with a wall surface defining the first channel at a position other than both ends of the first channel on the virtual straight line, the virtual straight line passing through a connecting portion, of the wall surface defining the first channel, to which the second wall surface is connected.

9. The liquid discharging head according to claim 1, wherein a bending angle of the first channel is not smaller than 90°.

10. The liquid discharging head according to claim 1, wherein when viewed from a third direction which is orthogonal to both the first direction and the second direction, the nozzle is positioned on a side of the third channel with respect to a bending position of the first channel, and when viewed from the third direction, the second channel is positioned on a side opposite to the nozzle with the bending position of the first channel sandwiched between the nozzle and the second channel.

* * * * *